US006751827B1

(12) United States Patent
Fok

(10) Patent No.: US 6,751,827 B1
(45) Date of Patent: Jun. 22, 2004

(54) DOOR KNOB HANDLE

(75) Inventor: Joe Fok, 13250 Franklin Ave., Mountain View, CA (US) 94040

(73) Assignee: Joe Fok, Mountain View, CA (US)

( * ) Notice: Subject to any disclaimer, the term of this patent is extended or adjusted under 35 U.S.C. 154(b) by 0 days.

(21) Appl. No.: 10/243,547

(22) Filed: Sep. 14, 2002

(51) Int. Cl.[7] ..... E05B 1/00
(52) U.S. Cl. ..... 16/413; 16/412; 16/422
(58) Field of Search ..... 16/413, 414, 417, 16/422, 427, 426, 429; 81/177.4, 490

(56) References Cited

U.S. PATENT DOCUMENTS 2,756,088 A * 7/1956 Sutter ..... 16/413
3,827,739 A * 8/1974 Overholser ..... 16/413
4,397,489 A * 8/1983 Lind ..... 16/414
4,504,087 A * 3/1985 Pennington ..... 16/413
4,783,883 A 11/1988 Szalay
4,913,479 A 4/1990 Allison
5,008,551 A * 4/1991 Randolph ..... 16/414
5,501,494 A 3/1996 Willetts
5,664,287 A * 9/1997 Sendelbach ..... 16/412
5,813,805 A * 9/1998 Kopras ..... 16/422

* cited by examiner

*Primary Examiner*—Lynne H. Browne
*Assistant Examiner*—Christopher Boswell

(57) ABSTRACT

A new leaver's attachment to a conventional round or oval shape type door knob, an effect for easy turning of any round or oval shape of knobs, the easy to install and remove attachment is for use primarily or portably by disabled persons and child to open a door.

5 Claims, 4 Drawing Sheets

DOOR KNOB HANDLE

FIELD OF THE INVENTION

The present invention relates to round and oval shape conventional door knob, which are a removable handle to door knobs to accomplish an easier turning function, thereof are intended to assist the person with difficult by turning on a round and oval shape conventional door knob and to open that door.

DESCRIPTION a. Human Factors Appreciation

Elderly, persons with arthritis, children or person carrying thing with both hands quite frequently have difficultly in turning a conventional rotation type door knobs. In many cases, it becomes necessary for such people to replace the door knobs and related fastener hardware due to their experienced difficulty in opening and closing a door.

b. Commercially Availability

At present, there are no commercially available items which could be easily attached to an existing door knob, where such device could be more easily to manage during a rotation action. There appears to be such a need for a device which can be attached to conventional door knobs, the present invention significantly will fulfills this need.

An attachment drawing of the invention is used in a rotary door knob; this patent discloses a formed sharp lever attachment for a round door knob secured by a clamp.

As shown in FIG. 1, the circular door knob handle of the present invention is comprising a handle on rotate then pull or push open a door, wherein the handle is disposed on the circular opening side of cup shape FIG. 1-1 and clamp on the handle portion.

As shown in FIG. 2, the circular door knob handle cup area FIG. 2-2 is formed as an open surrounding inner shape for gripping on to the door knob; a fastener tools FIG. 2-3 to assist the screw to compress the cup and handle to the knob, then plugs it back into the hole at the end of the handle FIG. 2-4 until next time to use.

As shown in FIG. 3, light curve on the top of the inside shell with a foam alike cushion will provide full contact to the surface of the knob; smooth exterior surfaces and soft rounded corners are all around on the handle FIG. 3-5. A long set-in shape area on FIG. 3-6 for screw head to eliminates the potential for injury.

As shown in FIG. 4, circular opening to fit most round or oval shape door knob, also accomplish as a clamp function to hold on the door knob by a build in thread inside: the handle and screw to. A screw turner FIG. 4-7 is provided for threading the screw.

As shown in FIG. 5, the entire assembly manufactured from a strong material, such as high impact plastic, or from metal such as aluminum, or the like. An open place FIG. 5-8 is provide for compressing, the inner shell is reduced to make a firm hold, the wide handle portion give a gripping hand a better hold on the lever. End of the handle's fastener tools resting opening can bowl a cord for pull down to open the door.

As shown in FIGS. 6 and 7, the fastener has build-in different shape of finger gaps for a better rotation holding.

As shown in FIGS. 8 and 9, handle portion area FIG. 8-9 and FIG. 9 with softer shape, wider and digger are enhanced hand gapping and pushing function.

As shown in FIGS. 10, 11, 12, the circular door knob handle cup area FIG. 12 is formed as both side open round encompassing inner shape for holding on to the door knob, soft tape type show on FIG. 12 inside wall is for secure with full contact from the center point to side surface of the door knob.

SUMMARY OF THE INVENTION

The entity of the present invention is to offer a "Add on door knob handle" which is a push or press handle that installed on the one or both side of the round or oval shape door lock and knob, so that the children, person or while carrying heavy objects, can reduced effect faction to unlock the door only through a certain part of human body or holdings to use by that person without assistance.

To take the advantage of modem manufacturing method, the present invention can produce by casting with plastic or metal to form a dynamic shape to achieve the best liaison between form of product and ergonomics.

BRIEF DESCRIPTION OF THE DRAWINGS

The invention will be better understood and objects other than those set forth above will become apparent when consideration is given to the following detailed description thereof. Such description makes reference to the annexed drawings wherein.

1. Outside shell of the cup portion.
2. Open end of the cup with space to compress to the handle portion.
3. A round and soft crave for all around the handle portion.
4. Resting area for fastener rotation tools.

Figure 1:
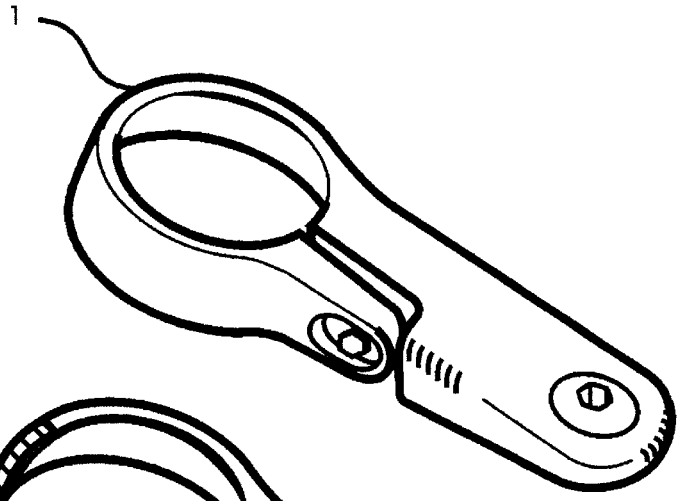
FIG. 1 is a perspective view of the door knob handle for the present invention.
Figure 2:
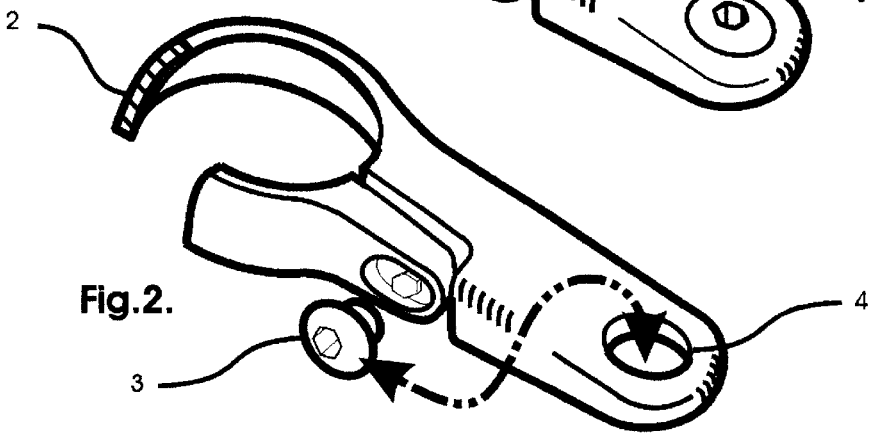

FIG. 2 is a perspective and cut out view of the door knob handle for the present invention.

FIG. 11-30 Cup shell is formed with an oval shape wall.

FIG. 11-31 Comprises a continuous strip of flexible foam rubber.

FIG. 11-32 A fastener rotation tools for to rotate the fastener.

FIG. 11-33 A hole for fastener rotation tools where for resting.

Figure 3:
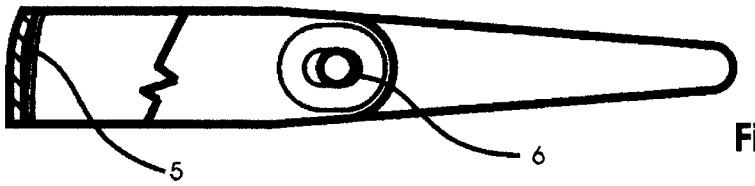

FIG. 3 is a side cut-off view of the door knob handle for the present invention.

FIG. 3-9 Cup shell on the top portion is formed with an oval shape wall.

FIG. 3-10 A round and soft crave for all around the handle portion.

FIG. 3-11 A hole to holding and positioning the fastener.

FIG. 3-12 A continuous strip of flexible foam rubber around the inner wall.

Figure 4:
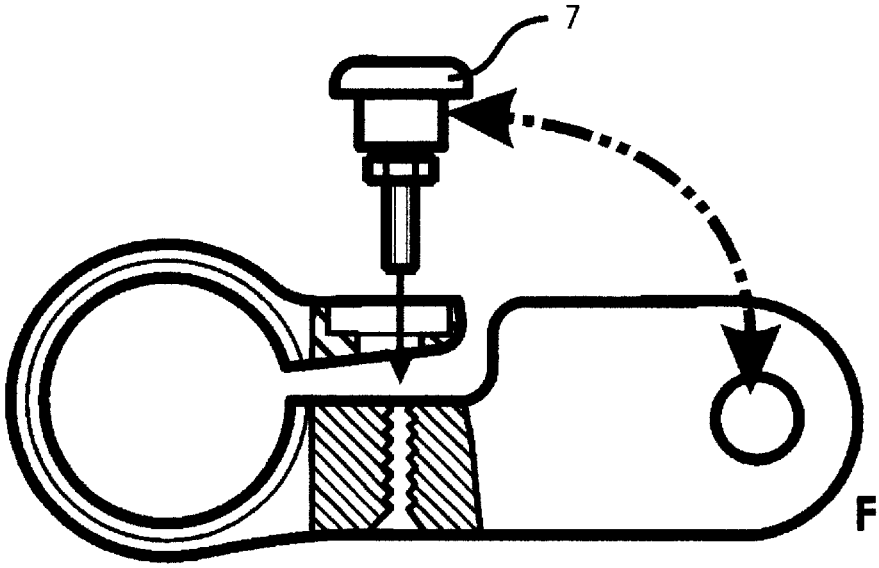

FIG. 4 is a front cut-off view of the door knob handle for the present invention.

FIG. 4-13 An open round wall shape to match the shape of door knob.

FIG. 4-14 A set in area to hide the fastener from uncomforting contact.

FIG. 4-15 A standard replaceable fastener.

FIG. 4-16 A rotation tools for to rotate the fastener.

FIG. 4-17 Where the rotation tools rest when not in use.

FIG. 4-18 An inside threaded handle body for fastener.

Figure 5:
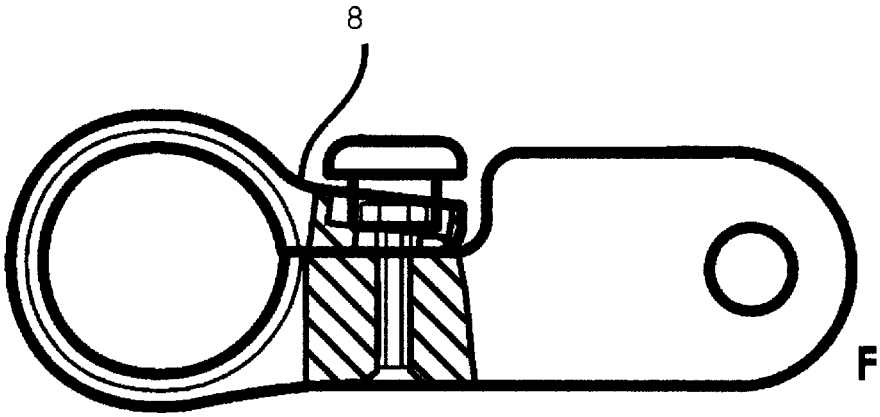

FIG. 5 is a front cut-off view of the door knob handle for the present invention.

FIG. 5-19 An extended open portion for compress the cup wall to hold the door knob in permanent position.

FIG. 5-20 A fastener tool on position to rotate the fastener.

FIG. 5-21 A round and soft crave for all around the handle portion.

FIG. 5-22 A body appearance with the stand out color and light glow in the dark plastic.

FIG. 5-23 Where the open end of the threaded hole.

FIG. 5-24 Where the fastener tightened to compress the cup's inner wall to have a firms hold on the door knob.

FIG. 5-25 A thin out-side wall as function for easy to coagulate the banding of the cup.

Figure 6:
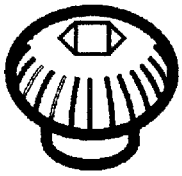

FIG. 6 is a perspective view of a rotation tool of the present invention.

FIG. 6-26 A rotation tool with knurl for easy grabbing.

Figure 7:
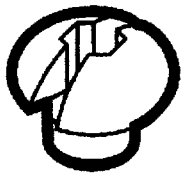

FIG. 7 is a perspective view of a rotation tool of the present invention.

FIG. 7-27 A rotation tool with center strip for easy grabbing and any extend flat tools as dinner knife or similar to assist to rotate the fastener.

Figure 8:
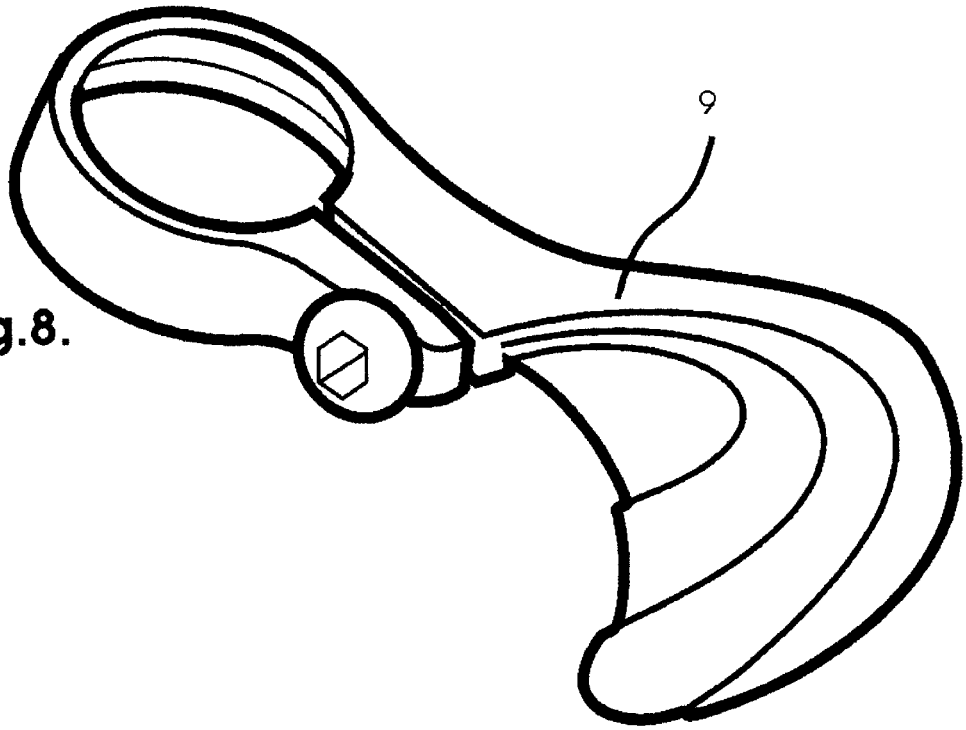

FIG. 8 is a perspective view of the door knob handle for the present invention.

FIG. 8-28 A free form of handle portion with shape of a human inner hand holding posture for maximum comfort.

Figure 9:
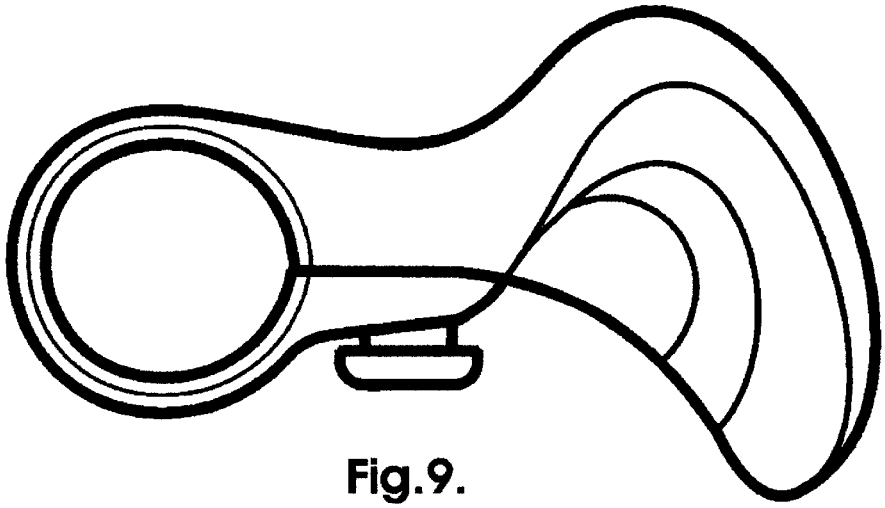

FIG. 9 is front view of the door knob handle for the present invention.

FIG. 9-29 A free form of handle portion with shape of a human inner hand holding posture for maximum comfort.

Figure 10:
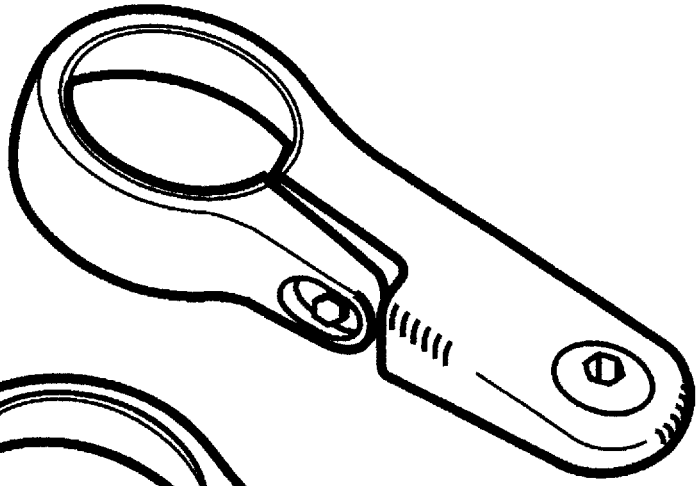

FIG. 10 is a perspective view of the door knob handle for the present invention.

FIG. 10-30 Outside shell of the cup portion.

FIG. 10-31 Open end of the cup with space to compress to the handle portion.

FIG. 10-32 A round and soft crave for all around the handle portion.

FIG. 10-33 Resting area for fastener rotation tools.

Figure 11:
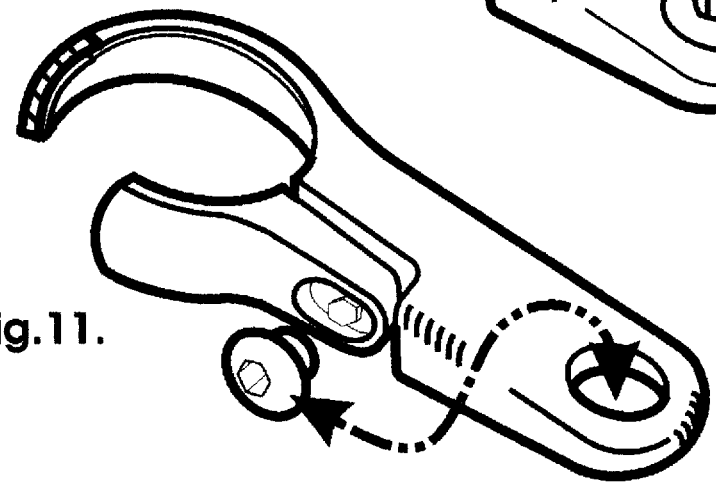

FIG. 11 is a perspective and cut out view of the door knob handle for the present invention.

FIG. 11-34 Cup shell is formed with an oval shape wall.

FIG. 11-35 Comprises a continuous strip of flexible foam rubber.

FIG. 11-36 A fastener rotation tools for to rotate the fastener.

FIG. 11-37 A hole for fastener rotation tools where for resting.

Figure 12:
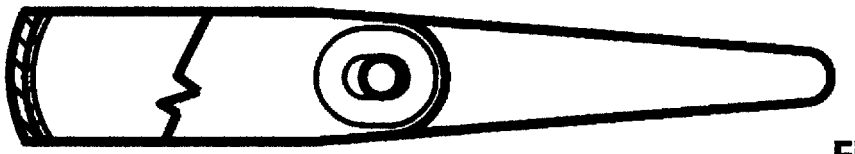

FIG. 12 is a side cut-off view of the door knob handle for the present invention.

FIG. 12-38 Cup shell on the inside portion is formed with an oval shape wall.

FIG. 12-39 A round and soft crave for all around the handle portion.

FIG. 12-40 A hole to holding and positioning the fastener.

FIG. 12-41 A continuous strip of flexible foam rubber around the inner wall.

What is claimed is:

1. An attachment for doorknobs comprising:

a handle body having a lever portion and an integral clamp portion having a cylindrical surface connected to the lever portion for releasably gripping door knobs of varied contour;

a member depending from said clamp portion, and spaced closely adjacent the lever portion;

a screw connecting said depending member and said lever portion together and readily detachably connecting said cylindrical surface to a door knob, wherein said clamp and said depending portion are interconnected; and at least one storage compartment within said lever portion, wherein said storage compartment is adapted to receive and hold a fastener tool, where said fastener tool is used to actuate said screw.

2. The attachment for doorknobs of claim 1, where the inside of the clamp is formed as an arc shape for holding a doorknob.

3. The attachment for doorknobs of claim 1, where said handle body is manufactured by casting, and machining the threads into the lever portion.

4. The attachment for doorknobs of claim 1, wherein said handle body is made from glow in the dark material.

5. The attachment for doorknobs of claim 3, wherein said handle body is made from glow in the dark material.

* * * * *